US006276822B1

(12) United States Patent
Bedrosian et al.

(10) Patent No.: US 6,276,822 B1
(45) Date of Patent: Aug. 21, 2001

(54) METHOD OF REPLACING A CONVENTIONAL VEHICLE LIGHT BULB WITH A LIGHT-EMITTING DIODE ARRAY

(76) Inventors: Yerchanik Bedrosian, 9618 Tujunga Canyon Blvd., Tujunga, CA (US) 91042; Ara Bedrosian, 12670 Pierce St., Pacoima, CA (US) 91331

( * ) Notice: Subject to any disclaimer, the term of this patent is extended or adjusted under 35 U.S.C. 154(b) by 0 days.

(21) Appl. No.: 09/239,196

(22) Filed: Jan. 28, 1999

Related U.S. Application Data

(60) Provisional application No. 60/075,386, filed on Feb. 20, 1998.

(51) Int. Cl.[7] ..... F21S 8/10
(52) U.S. Cl. ..... 362/545; 362/800; 362/226
(58) Field of Search ..... 362/226, 545, 362/800

(56) References Cited

U.S. PATENT DOCUMENTS

| | | | | |
|---|---|---|---|---|
| 4,733,335 | * | 3/1988 | Serizawa et al. | 362/80 |
| 4,868,719 | | 9/1989 | Kouchi et al. . | |
| 5,093,768 | | 3/1992 | Ohe | 362/241 |
| 5,101,326 | | 3/1992 | Roney | 362/545 |
| 5,388,035 | | 2/1995 | Bodem, Jr. | 362/545 |
| 5,463,280 | | 10/1995 | Johnson | 315/187 |
| 5,463,540 | | 10/1995 | Jones | 362/260 |
| 5,486,808 | | 1/1996 | Nejdl | 340/464 |
| 5,528,474 | | 6/1996 | Roney et al. | 362/545 |
| 5,567,036 | | 10/1996 | Theobald et al. | 362/485 |
| 5,570,951 | | 11/1996 | Bertling et al. | 362/231 |
| 5,669,703 | * | 9/1997 | Wheeler et al. | 362/249 |
| 5,765,940 | * | 6/1998 | Levy et al. | 362/240 |

* cited by examiner

*Primary Examiner*—Thomas M. Sember
*Assistant Examiner*—Ali Alavi
(74) *Attorney, Agent, or Firm*—Kelly Bauersfeld Lowry & Kelley, LLP

(57) ABSTRACT

A method is provided for replacing the incandescent bulb of a conventional vehicle warning assembly with a light-emitting diode (LED) array. The method includes the steps of removing the lens and conventional light bulb from the vehicle warning light assembly, accessing electrical leads and connecting them to an electrical connector of the LED array. The electrical connector of the LED array may be in the form of wires spliced to the electrical leads of the vehicle warning light assembly, or a bayonet connector which mates with a bayonet connector receiver of the warning light assembly. A license plate illuminating bulb may also be electrically connected to the warning light leads directly or indirectly through the electrical connection of the LED array.

19 Claims, 4 Drawing Sheets

METHOD OF REPLACING A CONVENTIONAL VEHICLE LIGHT BULB WITH A LIGHT-EMITTING DIODE ARRAY

RELATED APPLICATION

This application claims priority from provisional application Ser. No. 60/075,386, filed Feb. 20, 1998.

BACKGROUND OF THE INVENTION

The present invention relates to vehicle warning light assemblies such as taillights, head lights, brake lights, turn signal lights, dash lights, side marker lights, interior dome and courtesy lights and reverse lights. More particularly, the present invention relates to a conversion kit which allows one to easily replace the standard incandescent bulbs currently used in such vehicle warning light assemblies with a light-emitting diode array.

Presently, vehicle warning light assemblies are equipped with conventional filament light bulbs which have a number of well-known problems. For example, the light bulbs draw excessive current and in certain conditions are not bright enough to see from a trailing vehicle. Moreover, traditional light bulbs have a relatively short life span, requiring frequent replacement. However, light bulbs are oftentimes not replaced promptly, creating an unsafe vehicle condition and possible injury not only to those within the vehicle but also to persons in other vehicles as well.

Light emitting diodes (LEDs) have recently been developed for use as a light source in motor vehicle lamps. An advantage to using LEDs is that they typically have an operating life of as much as 100,000 hours before they begin to degrade. LEDs also draw less current from the vehicle's electrical system and emit more light than similarly configured or styled filament light bulbs.

Current systems utilizing LEDs suffer many disadvantages. In some, there are not enough LEDs to emit sufficient light to act as a taillight under government regulations. In others, a special housing and lens cover must be used to operate the system. Thus, the entire lamp assembly for a filament light bulb must be replaced to utilize an LED system. Replacing the entire assembly with a new system can be a difficult task for the average consumer. Additionally, replacement is oftentimes prohibitively expensive considering that nearly all vehicles in use today already have incandescent bulb systems in place.

Thus, what is needed is an LED system which utilizes a sufficient number of LEDs to emit light which meets the government regulations for warning lights such as taillights. Furthermore, a system is needed which is able to replace a conventional bulb without having to use special housings, or requiring the replacement of an existing warning light assembly. What is further needed is a system which is inexpensive and easy to install. The present invention fulfills these needs and provides other related advantages.

SUMMARY OF THE INVENTION

The present invention resides in method for replacing the incandescent bulb of a conventional vehicle warning assembly with a light-emitting diode (LED) array. The LED array is installed by removing the lens and conventional light bulb from the vehicle warning light assembly. Electrical leads for the warning light assembly are then accessed and electrically connected to an electrical connector of the LED array. A license plate illuminating bulb may also be electrically connected to the warning light leads directly or indirectly through the electrical connection of the LED array. The array is then typically secured to the warning light assembly and finally the lens is replaced to complete the replacement process.

The light-emitting diode (LED) array includes, generally, a mounting member and an electrical connector connected to a circuit board having, in circuit, a plurality of LEDs, at least one resistor, and at least one diode. The LEDs may be arranged in an array of one side or both sides of the circuit board. The array can be secured to the warning light assembly by screws inserted through mounting member apertures and threaded into apertures in the assembly. Assembly apertures are drilled into the assembly if there are no existing apertures, or if the existing apertures do not align with the mounting member apertures.

In one embodiment, the electrical connector of the array includes wires which are spliced to the electrical leads of the warning light assembly, forming the electrical connection between the array and the assembly. The array is attached to the warning light assembly and the lens is replaced.

In another embodiment, the electrical connector is comprised of a bayonet connector capable of being inserted into a bayonet connector receiver of the warning light assembly. The lightbulb is removed from the bayonet connector receiver of the warning light assembly and the bayonet connector, which is electrically and physically connected to the array, is inserted and secured into the mating bayonet connector receiver. The array is then attached to the warning light assembly and the lens is replaced.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
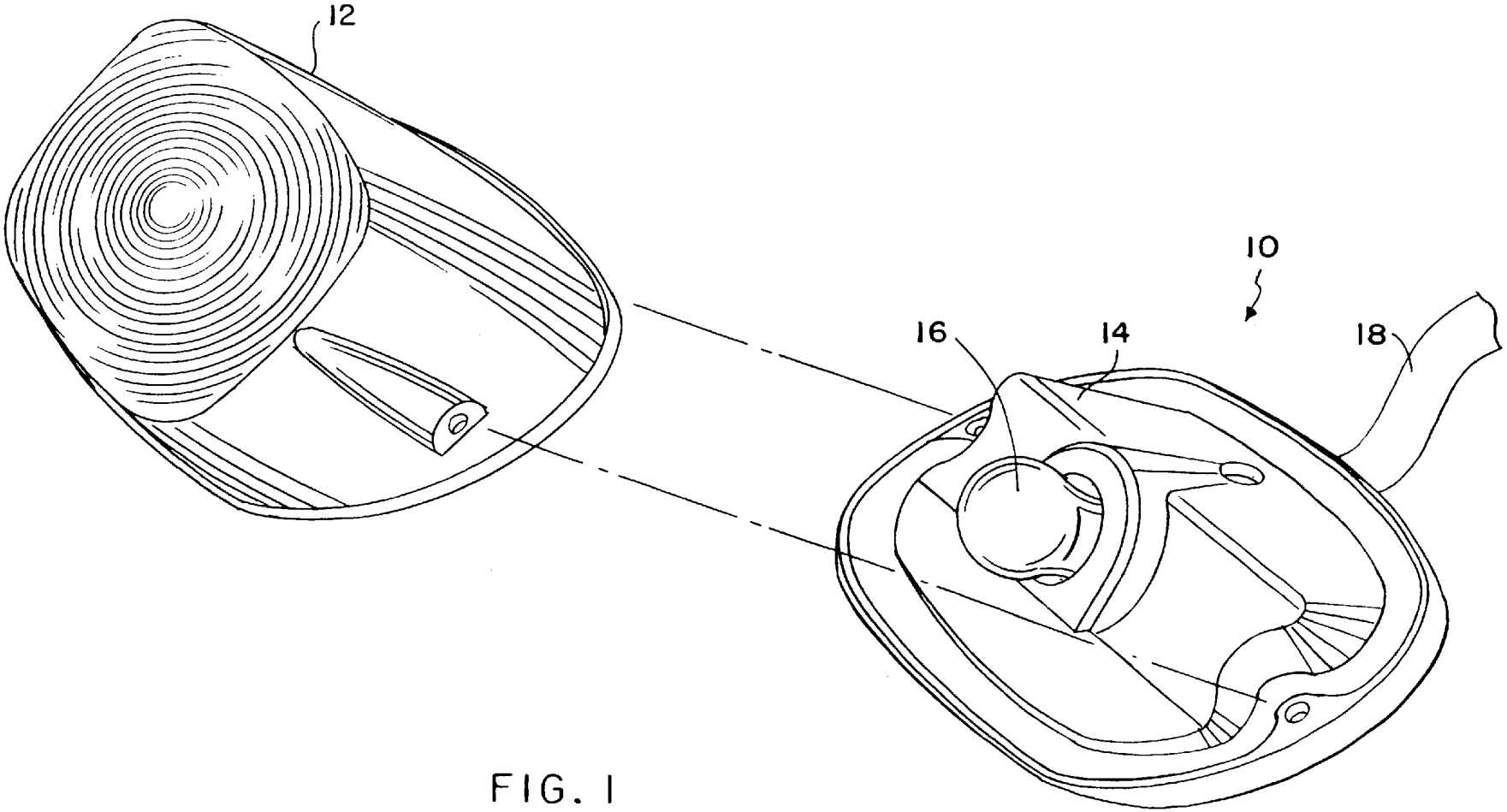
FIG. 1 is an exploded perspective view of a traditional taillight assembly illustrating a lens removed from the remainder of the taillight assembly, which includes an incandescent bulb, electrical lead wiring and a taillight housing.

As shown in the drawings for purposes of illustration, the present invention is concerned with a method of using a conversion kit to replace a traditional light bulb 16 of a vehicle warning light assembly with a light-emitting diode (LED) array, generally designated by the reference number 20. The method of replacing the light bulb 16 with the light-emitting diode array 20 is relatively simple and does not require the replacement of the essential components of the vehicle warning light assembly.

As used herein, the term "vehicle warning light assemblies" includes taillights, headlights, brake lights, turn signal lights, dash lights, side marker lights, interior dome and courtesy lights, map lights and reverse lights. This list is exemplary only, as other types of vehicle warning lights may advantageously use the invention also. The accompanying drawings illustrate the present invention as applied to a taillight assembly 10.

As shown in FIG. 1, the taillight assembly 10 typically includes a lens 12 which is attachable to a taillight housing 14, and a traditional incandescent light bulb 16 secured within the housing 14 and electrically connected to taillight electrical leads 18. In accordance with the present invention, and with reference to FIGS. 2–4, to replace the light bulb 16 with the light-emitting diode (LED) array 20, the lens 12 and the traditional incandescent light bulb 16 are first removed from the taillight assembly 10. Depending on the vehicle, the assembly 10 may have to be removed from the vehicle before removing the light bulb 16. The electrical leads 18 of the assembly 10 are then accessed and electrically connected to the array 20. The light-emitting diode array 20 is then secured to the taillight assembly 10 and the lens 12 is replaced. Using this method, only the traditional light bulb 16 is replaced while the other component parts of the assembly 10 are retained.

Figure 2:
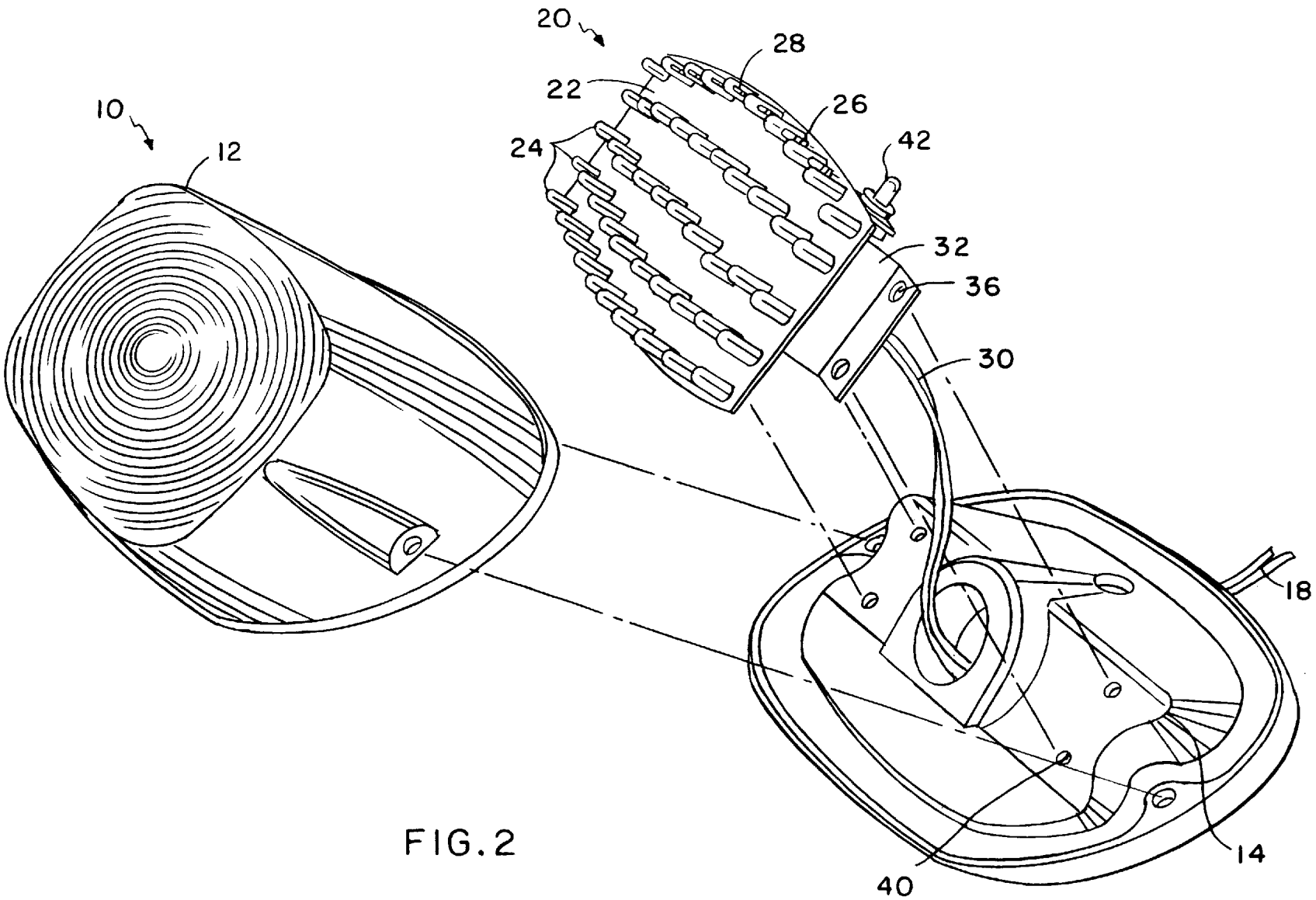
FIG. 2 is an exploded perspective view of the taillight assembly of FIG. 1, illustrating replacement of the incandescent bulb with a light-emitting diode (LED) array.

As shown in FIG. 2, the light-emitting diode array 20 includes an electrical connector 30 and a mounting member 32 connected to a circuit board 22 having, in circuit, multiple light-emitting diodes (LEDs) 24, at least one resistor 26, and at least one diode 28. As shown in FIG. 2, the electrical connector 30 is in the form of extending wires. After the lens 12 is removed from the taillight assembly 10, the light bulb 16 is removed. Certain models of vehicles may require drilling out a light bulb assembly mount to fully remove the light bulb 16. Some may require simply unscrewing screws to remove the light bulb assembly. Other models may require the removal of obstructions, such as light bulb posts, remaining after the light bulb 16 is removed. This is easily accomplished by cutting away any remaining objects with wire cutters.

The taillight assembly electrical leads 18 are then accessed and electrically connected to the electrical connector wires 30 of the LED array 20 by splicing the wires 18 and 30 together. A license plate illuminating light bulb or LED 42 may also be electrically connected to the assembly leads 18 directly, or indirectly by electrically connecting the license plate bulb or LED 42 to the array 20.

Figure 4:
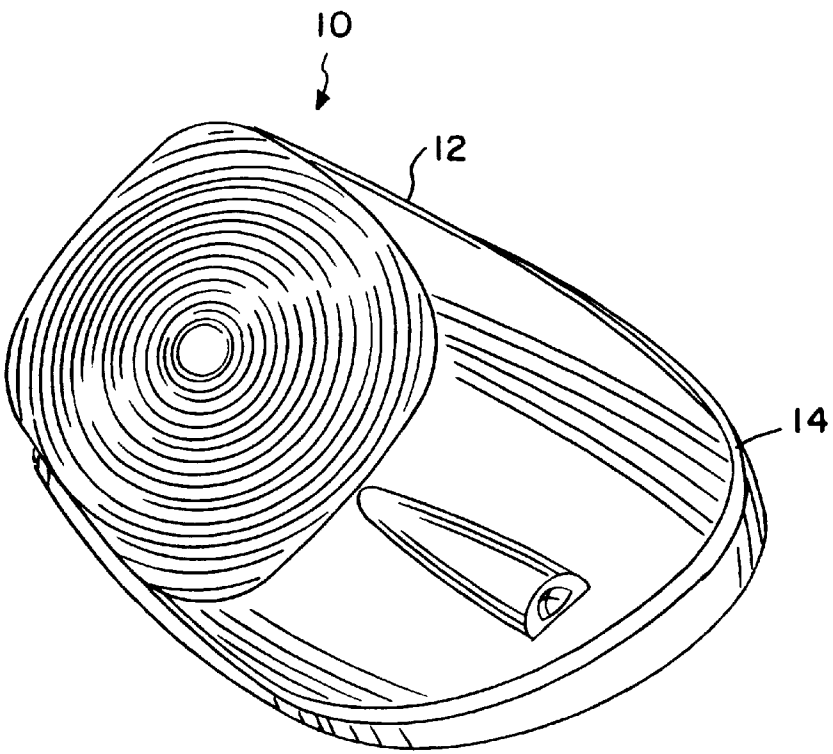
FIG. 4 is an elevational view of the taillight assembly of FIGS. 2 and 3 with the lens in place over the LED array.
Figure 3:
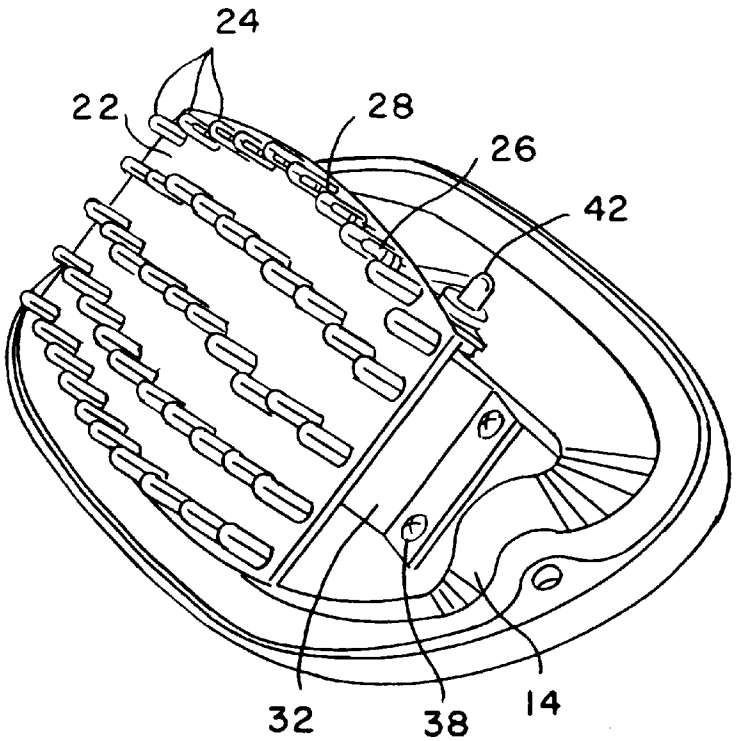
FIG. 3 is an elevational view of the taillight assembly of FIG. 2 (less the lens), illustrating the LED array secured to the housing.

As shown in FIG. 3, the array 20 is then secured to the housing 14 of the assembly 10. The mounting member 32 of the array 20 is connected to the circuit board 22 in an electrically insulated manner, typically with insulated screws or adhesive. The mounting member 32 includes apertures 36 which align with housing apertures 40 and through which screws 38 are inserted and fastened to secure the LED array 20 in place. Housing apertures 40 are drilled into the taillight assembly housing 14 before inserting the screws 38 if there are no existing apertures, or if the existing apertures do not align with the mounting member apertures 36. After the array 20 is secured to the taillight assembly 10, the lens 12 is replaced as illustrated in FIG. 4.

Figure 6:
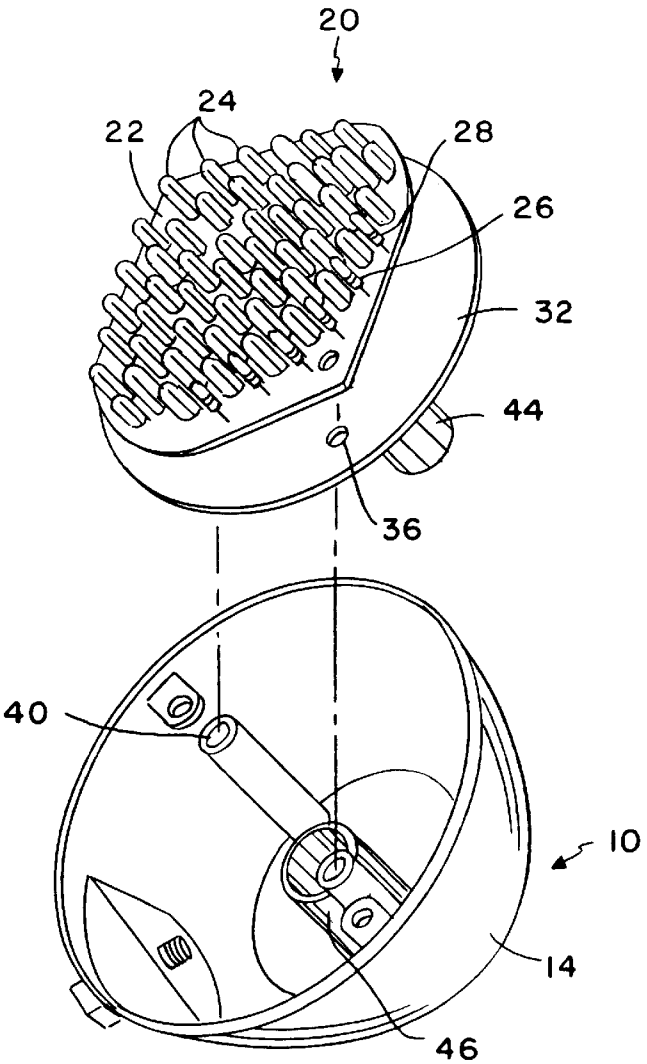
FIG. 6 is an exploded perspective view of the taillight assembly of FIG. 5, but wherein an LED array having a bayonet connector mates with a bayonet connector receiver of the taillight assembly.
Figure 5:
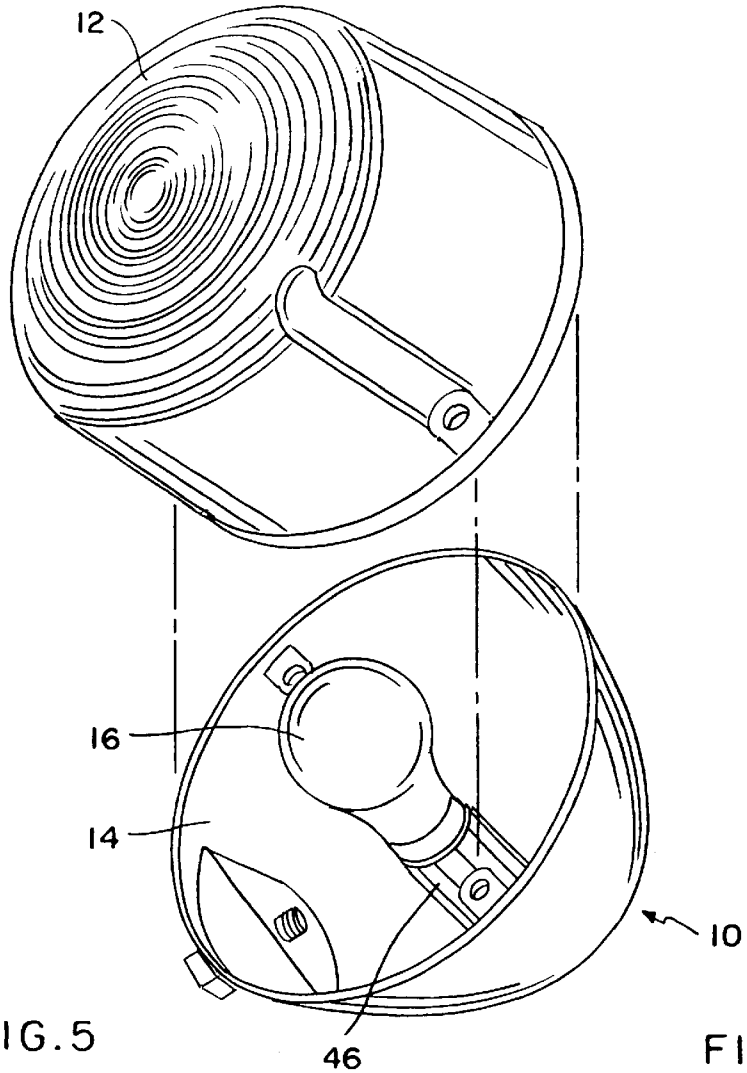
FIG. 5 is an exploded perspective view of another type of taillight assembly having a bayonet-type connection between the bulb and housing.

Another common type of taillight assembly 10 is illustrated in FIG. 5 and includes a lens 12, incandescent light bulb 16 and housing 14, but utilizes a bayonet connector receiver 46 to hold and electrically connect the light bulb 16 with the electrical system of the vehicle. To be compatible with this type of taillight assembly 10, the LED array 20 may be configured with a bayonet electrical connector 44, as shown in FIG. 6. The bayonet connector 44 is electrically connected to the electrical circuit of the array and physically connected to the mounting member 32. As such, the replacement of the incandescent bulb 16 with the array 20 is easily accomplished by removing the light bulb 16 from the bayonet receiver 46 and then simply pushing and twisting the bayonet connector 44 of the LED array into the bayonet connector receiver 46. The array 20 is electrically connected to the taillight assembly 10 and correctly positioned with or without further adjustment. The array 20 may be securely fastened to the assembly housing 14 with screws 38 inserted through the mounting member apertures 36 and assembly housing apertures 40.

Of course there are other means of connecting the LED array to a vehicle warning light assembly. For example, the LED array may be fitted with a threaded electrical connector for threaded reception into a corresponding electrical socket.

The present invention allows one to economically and conveniently replace his or her vehicle taillight incandescent bulbs 16 with an light-emitting diode (LED) array 20. There is no need to purchase and install an entirely new taillight assembly. Complicated construction or assembly in installing the array 20 is eliminated as the conversion kit uses almost all of the original components of the taillight assembly 10, typically only replacing the light bulb 16 with the array 20. By replacing the incandescent light bulb 16 with the light-emitting diode array 20, the user obtains the benefit of a vehicle warning light which is not only brighter when illuminated, but which also uses less electricity and lasts many more hours before failure.

Although two embodiments have been described in detail for purposes of illustration, various modifications of each and additional embodiments can be made without departing from the scope and spirit of the invention. Accordingly, the invention is not to be limited, except as by the appended claims.

What is claimed is:

1. A method for replacing a conventional vehicle light bulb with a light-emitting diode array, comprising the steps of:

removing a lens and the conventional light bulb from a vehicle warning light assembly;

providing a light-emitting diode array including a mounting member and an electrical connector connected to a circuit board having, in circuit, multiple light-emitting diodes, at least one resistor, and at least one diode;

accessing an electrical lead for the vehicle warning light assembly;

electrically connecting the light-emitting diode array to the electrical lead of the vehicle warning light assembly by splicing the electrical leads of the vehicle warning light assembly to wires of the electrical connector; and securing the light-emitting diode array to the vehicle warning light assembly.

2. The method of claim 1, including the step of removing the vehicle warning light assembly from a vehicle before removing the light bulb.

3. The method of claim 1, including the step of electrically connecting a license plate illuminating bulb to the electrical leads of the vehicle warning light assembly.

4. The method of claim 1, wherein the step of removing the light bulb includes drilling out the light bulb assembly mount.

5. The method of claim 1, wherein the step of securing the array to the vehicle warning light assembly includes attaching the mounting member to the vehicle warning light assembly with screws.

6. The method of claim 5, including the step of drilling holes into the vehicle warning assembly before the mounting member is attached to the vehicle warning light assembly.

7. The method of claim 1, including the step of replacing the lens over the vehicle warning light assembly.

8. The method of claim 5, including the step of replacing the lens over the tail light assembly.

9. A method for replacing a conventional vehicle light bulb of a taillight assembly with a light-emitting diode array, comprising the steps of:

removing a taillight lens and a conventional light bulb from the taillight assembly;

providing a light-emitting diode array including a license plate light light-emitting diode;

accessing electrical leads for the taillight assembly;

electrically connecting the electrical leads of the taillight assembly to corresponding electrical connector wires of the light-emitting diode array;

electrically connecting the license plate light bulb to the electrical leads of the taillight assembly; and securing the light-emitting diode array to the taillight assembly.

10. The method of claim 9, wherein the light-emitting diode array includes a mounting member and an electrical connector connected to a circuit board having, in circuit, multiple light-emitting diodes, at least one resistor, and at least one diode.

11. The method of claim 10, wherein the step of securing the array to the taillight assembly includes attaching the mounting member to the taillight assembly with screws.

12. The method of claim 11, including the step of drilling holes into the taillight assembly before the mounting member is attached to the taillight assembly.

13. The method of claim 12, including the step of removing the taillight assembly from a vehicle before removing the light bulb.

14. A method for replacing a conventional vehicle light bulb with a light-emitting diode array, comprising the steps of:

providing a light-emitting diode array including a license plate light light-emitting diode;

accessing an electrical lead for the vehicle warning light assembly;

electrically connecting the light-emitting diode array to the electrical lead of the vehicle warning light assembly;

electrically connecting the license plate illuminating light-emitting diode to the electrical leads of the vehicle warning light assembly; and securing the light-emitting diode array to the vehicle warning light assembly.

15. The method of claim 14, including the step of removing a lens and the conventional light bulb from a vehicle warning light assembly prior to the accessing step.

16. The method of claim 14, wherein the light-emitting diode array includes a mounting member and an electrical connector connected to a circuit board having, in circuit, multiple light-emitting diodes, at least one resistor, and at least one diode.

17. The method of claim 16, wherein the step of electrically connecting the vehicle warning light assembly to the array includes splicing the electrical leads of the vehicle warning light assembly to wires of the electrical connector.

18. The method of claim 15, including the step of replacing the lens over the vehicle warning light assembly after the securing step.

19. A method for replacing a conventional vehicle light bulb with a light-emitting diode array, comprising the steps of:

removing a lens and the conventional light bulb from a vehicle warning light assembly;

providing a light-emitting diode array including a mounting member and an electrical connector connected to a circuit board having, in circuit, multiple light-emitting diodes, at least one resistor, and at least one diode;

electrically connecting the light-emitting diode array to the electrical lead of the vehicle warning light assembly by splicing the electrical leads of the vehicle warning light assembly to wires of the electrical connector;

electrically connecting a license plate illuminating light-emitting diode to the electrical leads of the vehicle warning light assembly; and securing the light-emitting diode array to the vehicle warning light assembly.

* * * * *